US006722098B2

(12) United States Patent
Platt

(10) Patent No.: US 6,722,098 B2
(45) Date of Patent: Apr. 20, 2004

(54) BEAM FOR DRYWALL CEILING

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 120 days.

(21) Appl. No.: 10/079,942

(22) Filed: Feb. 21, 2002

(65) Prior Publication Data

US 2003/0154686 A1 Aug. 21, 2003

(51) Int. Cl.[7] ..... E04B 5/52

(52) U.S. Cl. ..... 52/733.1; 52/506.07; 52/730.6; 52/731.7

(58) Field of Search ..... 52/506.07, 733.1, 52/730.6, 731.7, 716.8, 281, 483.1

(56) References Cited

U.S. PATENT DOCUMENTS

| | | | | |
|---|---|---|---|---|
| RE31,528 E | | 3/1984 | Mieyal | |
| 4,434,594 A | * | 3/1984 | Bliss | 52/209 |
| 4,520,609 A | | 6/1985 | Worley et al. | |
| 4,542,615 A | * | 9/1985 | McCall | 52/733.1 |
| 4,713,919 A | | 12/1987 | Platt | |
| 4,817,357 A | | 4/1989 | Hocevar | |
| 5,076,036 A | * | 12/1991 | Kuiper | 52/506.07 |
| 5,839,246 A | * | 11/1998 | Ziegler et al. | 52/506.07 |
| 6,047,512 A | | 4/2000 | Wendt et al. | |

OTHER PUBLICATIONS

See Attached Copy of European Search Report Issued by European Patent Office on May 28, 2003 in European Patent Application No. 02025949.5–1255–.

* cited by examiner

*Primary Examiner*—Carl D. Friedman
*Assistant Examiner*—Basil Katcheves
(74) *Attorney, Agent, or Firm*—Eugene Chovanes

(57) ABSTRACT

A beam for a grid in a ceiling that has drywall affixed to the grid by self-tapping screws.

The beam has a hem rolled downwardly and inwardly along the edge of both flanges of the beam. The hem prevents the flange from bending upward and sliding off the screw tip. The screw tip enters one of many indentations in the flange and is captured. The captured screw tip penetrates the flange and secures the drywall to the beam.

The beam does not have a face cap over the flanges.

2 Claims, 6 Drawing Sheets

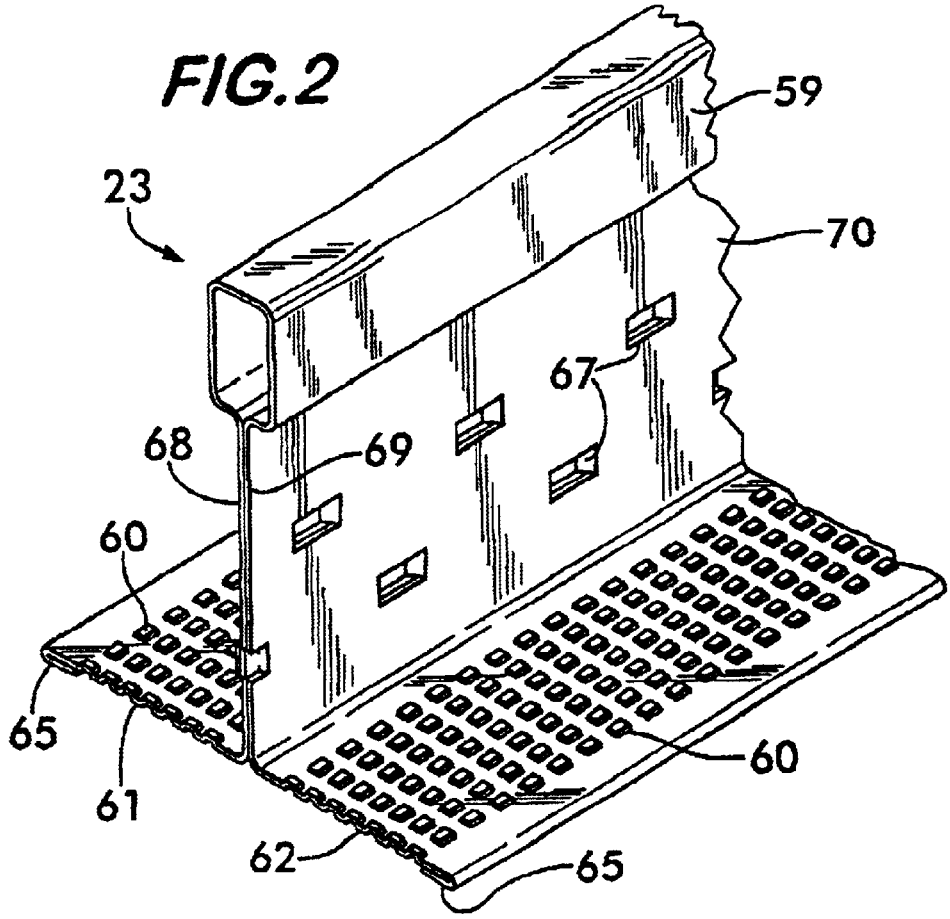
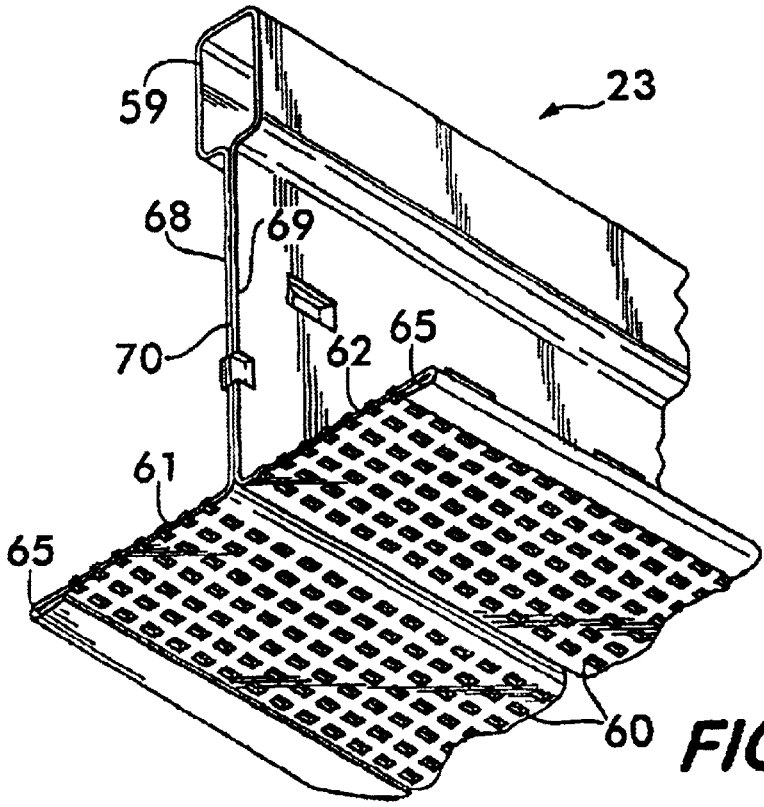
FIG.3

59
23
69
68
70
5
71
67
65
60
71
60
61
62
60
65
66
20
73
21
20
5
21

31
32
55
56
53
30
37
58
33
40
40
35
36
38
41
43
41
42
44

BEAM FOR DRYWALL CEILING

FIELD OF THE INVENTION

This invention relates to beams that form a grid in a suspended ceiling that has drywall or plasterboard affixed to the beams by self-tapping screws.

DESCRIPTION OF THE RELATED ART

Beams used in grids for suspended ceilings are well known. The ceilings are either of a panel type that have panels placed in grid openings, and supported by the intersecting beams, or of a drywall or plasterboard type, wherein sheets of drywall are screwed by self-tapping screws, into the beams of the grid.

The beams, which are essentially the same for both types of ceilings, are formed by folding a strip of metal longitudinally, as by continuous rolling, into an inverted T cross section, with a bulb at the top, a two-layered web extending down from the bulb, two flanges extending horizontally opposite from one another at the lower end of the web, and a face cap over the bottom of the flanges that is folded back over, and above, the edges of the flanges. The face cap in a beam for a drywall ceiling, has indentations over its surface that capture self-tapping screws to permit the screws to penetrate the face cap and the flange. The face cap functions to hold the layers of the web together, and to carry the indentations that capture the screws.

The beams for drywall suspended ceilings have been adapted from the much more popular panel ceilings by simply forming indentations in the face cap. Beams for suspended ceilings having panels do not have the indentations in the face cap as do those beams for drywall suspended ceilings.

Since, in a drywall ceiling, the self-tapping screws are inserted from below into the tee beam by the installer without being able to see the beam, placement of the screw on the tee beam face cap is not exact, and the screw, when inserted near the edge of the face cap, often pushes the face cap and flange upwardly away from the screw without penetrating the cap and flange.

The edge of the cap and flange lack the rigidity to resist the force of the screw prior to penetration, and the indentation lacks sufficient holding power to retain a captured screw tip until penetration. The resulting lack of connection between the screw and tee reduces the drywall support, and generally is undetected by the installer.

BRIEF SUMMARY OF THE INVENTION

The beam of the invention has no face cap as in the prior art. The flanges themselves of the tees are indented, and the edges of the flanges are hemmed by folding the edges downwardly and inwardly. The layers of the web of the beam are desirably secured together by, for example, stitching, so that the web is not separated in the event a screw tip contacts the tee between the two layers of the web at the centerline.

The downwardly and inwardly extending hem on the edge of each flange creates a barrier that keeps the edge of the flange in contact with the screw tip when a screw is placed near the edge, so the edge cannot lift up off the screw tip. The point of the screw is captured into one of the indentations adjacent the hem where, as the screw rotates, it penetrates into and through the flange to screw the wallboard to the tee.

A further advantage of the invention over the prior art is that since there is no need for a face cap, there is a savings in metal, in addition to the superior results from having virtually all of the self-tapping screws engage the beam to support the wallboard.

BRIEF DESCRIPTION OF SEVERAL VIEWS OF THE DRAWINGS

FIG. 2 is a partial perspective view of a beam of the invention taken from above.

FIG. 3 is a partial perspective view of the beam of FIG. 2 taken from below.

FIG. 7 is a perspective view of the grid from below.

FIG. 8 shows a screw about to contact the grid near the edge of the grid.

FIG. 9 shows the screw fully inserted, with the edge of the grid bent upward, and without the screw penetrating the grid.

FIG. 10 is a cross section of a prior art beam with a screw inserted on the center line of the web, and with a screw at the edge lifting the face cap and flange without penetration.

DETAILED DESCRIPTION OF THE INVENTION

Figure 1:
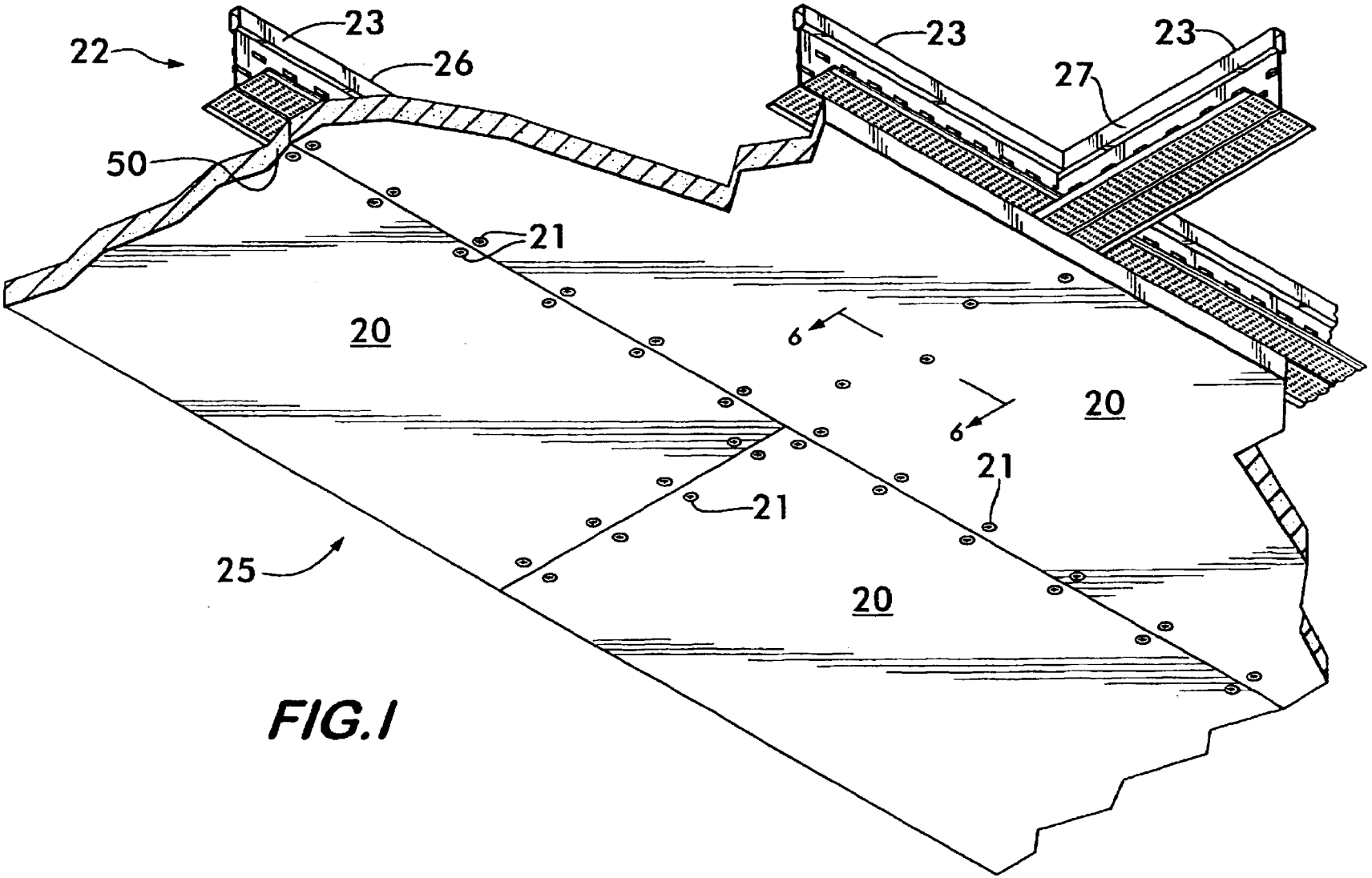
FIG. 1 is a partial perspective view, from below, of a suspended drywall ceiling, that uses the beam of the invention.

As seen in FIG. 1, drywall 20, or plasterboard, as it is often referred to, in large sheet form is affixed by self-tapping screws 21 to a grid 22 of grid tee beams 23, to form a suspended drywall ceiling 25.

The grid 22 is suspended from a structural ceiling by hang wires or the like, in the well known manner of suspended ceilings.

The grid 22 is formed of main beams 26 interlocking with perpendicular extending cross beams 27. Both main beams 26 and cross beams 27 are of an identical inverted tee cross section as seen, for instance, in FIG. 4, and will be simply referred to as beams 23.

The construction of a suspended drywall ceiling is well known. First, the grid 22 is constructed of the tee beams 23, and suspended by hang wires from a structural ceiling. Large sheets of drywall 20 are then secured to grid 22 from below by self-tapping screws 21 inserted by an installer with a power screwdriver, through the drywall 20 into the tee beam 23.

Figure 8:
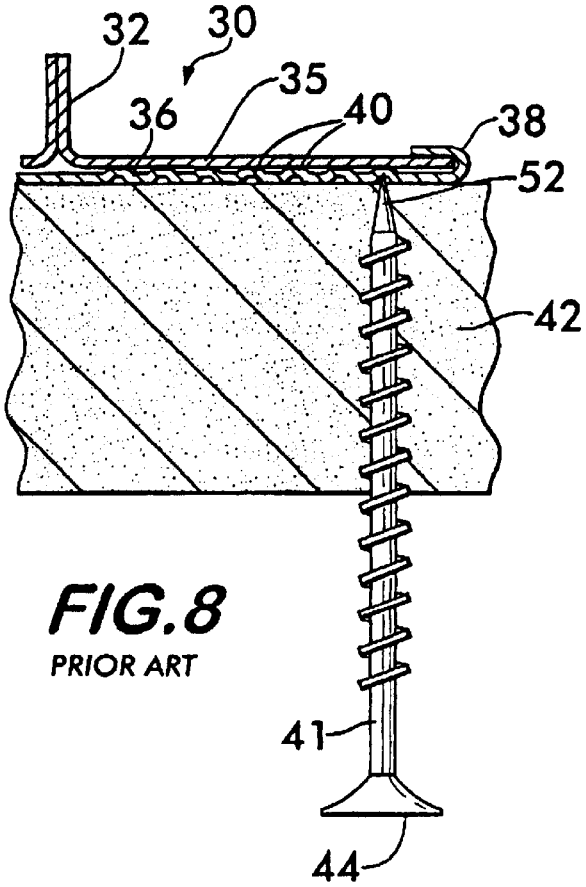
FIG. 8 PRIOR ART
Figure 9:
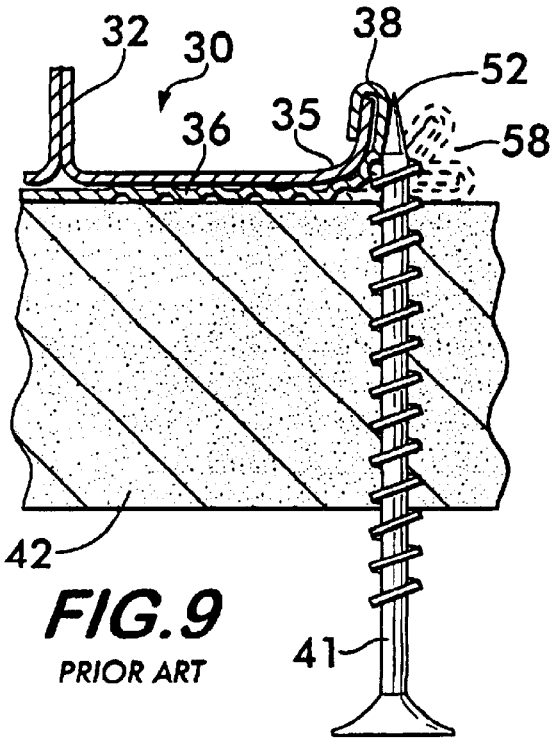
FIG. 9 PRIOR ART
Figure 10:
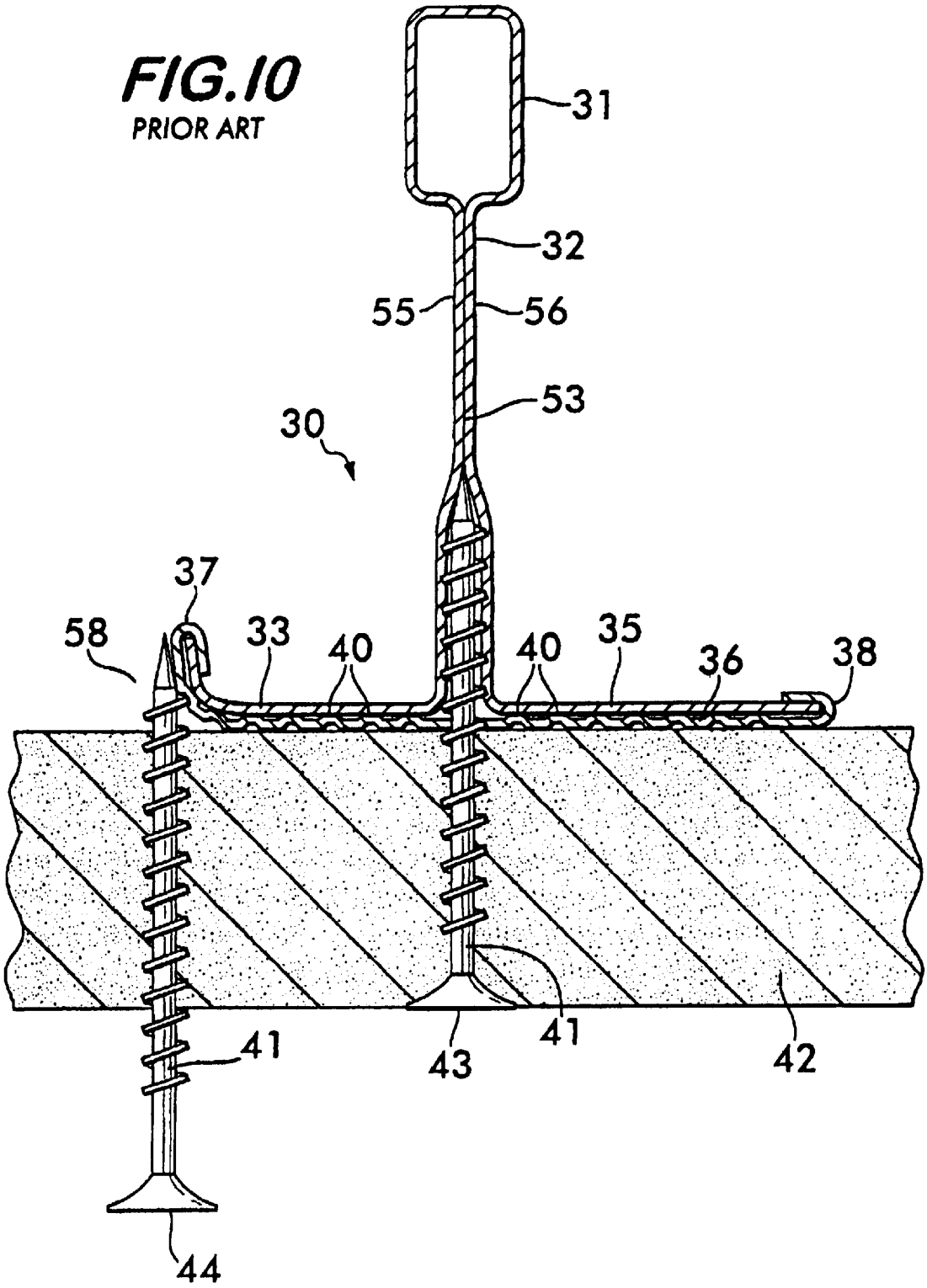
FIG.10 PRIOR ART

A prior art tee beam 30 is shown in FIGS. 7 through 10. As seen in FIG. 10, the beam 30 is in the form of an inverted T, with a bulb 31 at the top, a two-layered web 32 extending downwardly from the bulb 31, outwardly opposite extending flanges 33 and 35 at the bottom of the web 32, and a face cap 36 extending over the bottom of the flanges 33 and 35, and secured thereto by upwardly and inwardly extending portions 37 and 38.

The face cap has indentations 40 to capture the screws 41 as they engage from the drywall 42 upwardly as seen in FIG. 8. The screws 41 are power turned into a seated position as seen in FIG. 10 to hold the drywall 42 securely to the prior art grid tee 30.

The sheets of drywall 42 may correspond in size to the distance between the centerlines of beams in the grid, as seen at 50 in FIG. 1, or the sheets may extend over the grid, as seen in 51 in the same Figure.

In the prior art, when a screw 41 is placed inwardly of the edge of the flange 35 and face cap 36 of the beam 30, the screw point 52 is captured and the screw 41 penetrates the cap 36 and flange 35, with no movement.

As seen in FIG. 10 at 43, where the screw 41 coincides with the centerline 53 of the grid between the web layers 55 and 56, the screw 41 continues up between the layers 55 and 56, with the face cap 36 keeping the web 32 from splitting apart.

A problem in the prior art arises when the screw 41 contacts the face cap 36 and flange 35 near the edges, as seen in FIGS. 9 and 10. Often, the tip 52 of the screw 41 simply bends the cap 36 and flange 35 upwardly, without penetrating or engaging the cap 36 and flange, as seen at 58 in FIGS. 9 and 10.

This generally occurs, even though the point 52 of the screw 41 engages an indentation 40, as seen in FIG. 8. The edges of the face cap 36 and flange 35 lack sufficient resistance to the force necessary to penetrate both layers of the face cap 36 and flange 35.

The thickness at the edge of the face cap 36 includes three layers, two of which are the cap 36, and one layer of flange 35. This increases the difficulty of penetration, and contributes to the bending effect.

This results in many screws 41, unknowingly to the installer, not engaging the beam 30, and not contributing to the support of the drywall 42 by the grid.

In the present invention, as seen in FIGS. 1 through 6, the beam 23 in cross section is generally the same as in the prior art with a bulb 59 and a two-layered web 32. However, there is no face cap 36 on the beam 23. The upward indentations 60 are extended over the bottom of the flanges 61 and 62 of the grid tee beam, as seen in these Figures.

A hem 65, extends along the edge of each flange 61 and 62. The hem 65 is formed by folding, as by rolling when the beam is being formed, the metal edge downward and inward against the bottom of the flange.

Stitches 67, or other forms of fastening, such as welding, hold the two layers 68 and 69 of web 70 together to give a rigidity to the beam 23 that compensates for the omission of the prior art face cap 36 as described above.

Figure 4:
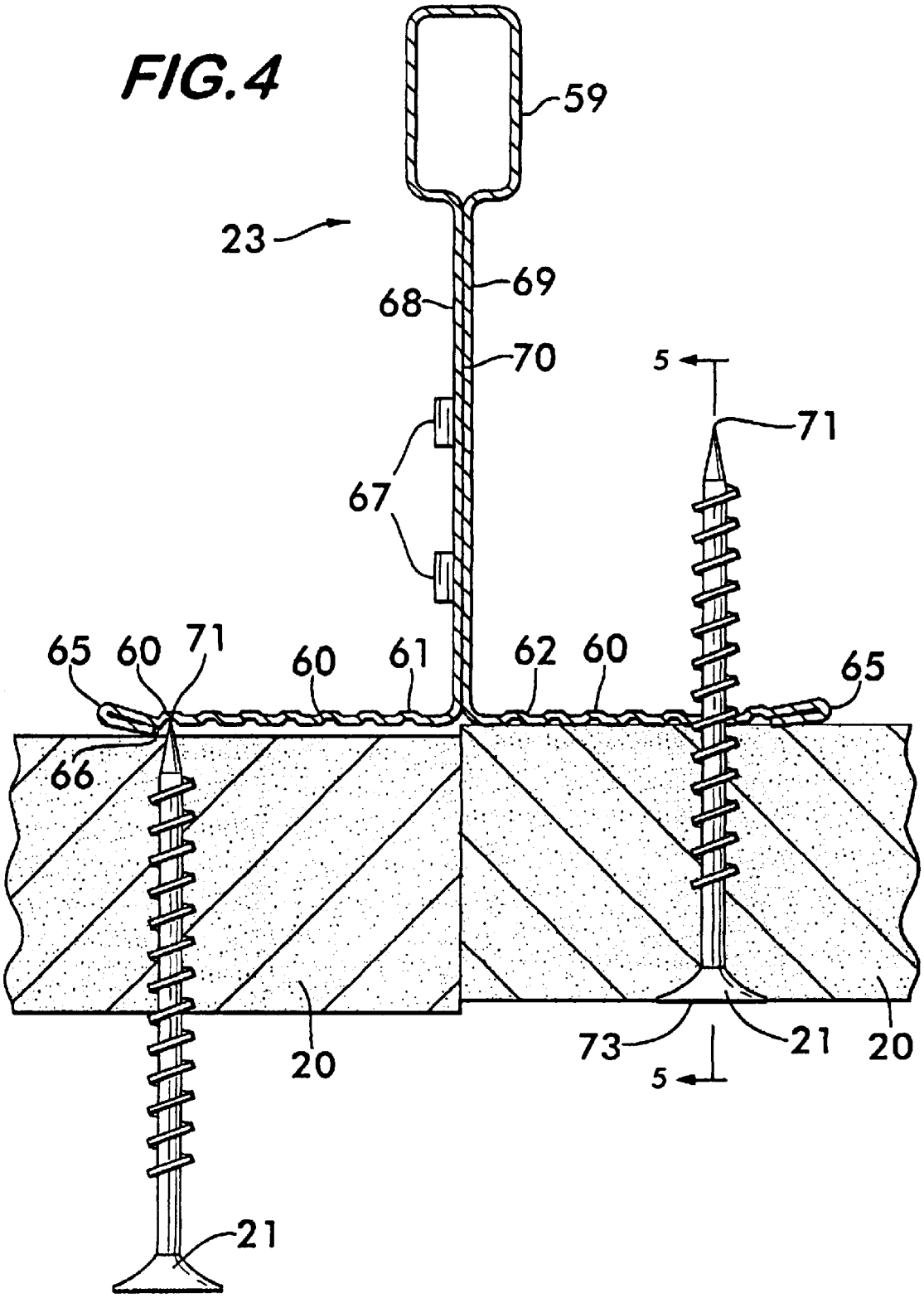
FIG. 4 is a cross section of a drywall ceiling portion showing drywall attached, and drywall about to be attached, near the edges of the flanges, to a beam of the invention.

As seen in FIG. 4, any tendency of a screw point 71 near the edge of a flange 61 or 62 to lift the edge of the flange upward, causing the flange to slide off the screw, is resisted, as seen in FIG. 4.

The screw point engages the hem 65 at 66 so that the screw point 71 is prevented from lifting, and sliding off, the edge of the flange 61 or 62 before the point seats in an indentation 60 and penetrates the flange. Once the point 71 penetrates the flange 61 or 62, the threads on the screw 21 secure the drywall 20 and flange 61 or 62 together with no further lifting of the flange 61 or 62, as seen in FIG. 4, at the right, at 73.

In this manner, all screws 21 are engaged with the grid tee beams 23, even though they contact the beams 23 near the edge of the flange 61 or 62.

Figure 5:
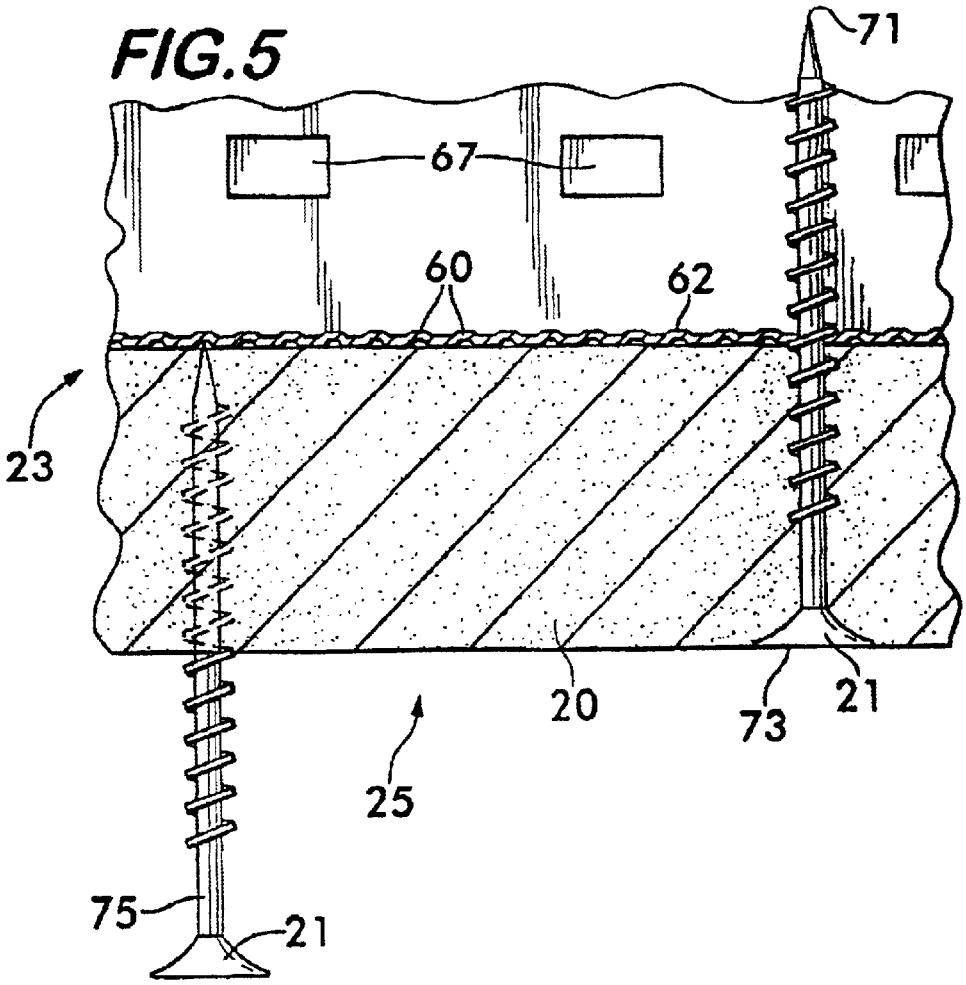
FIG. 5 is a section taken in the direction of the line 5—5 in FIG. 4, showing a screw completely seated, and one about to penetrate the flange.
Figure 6:
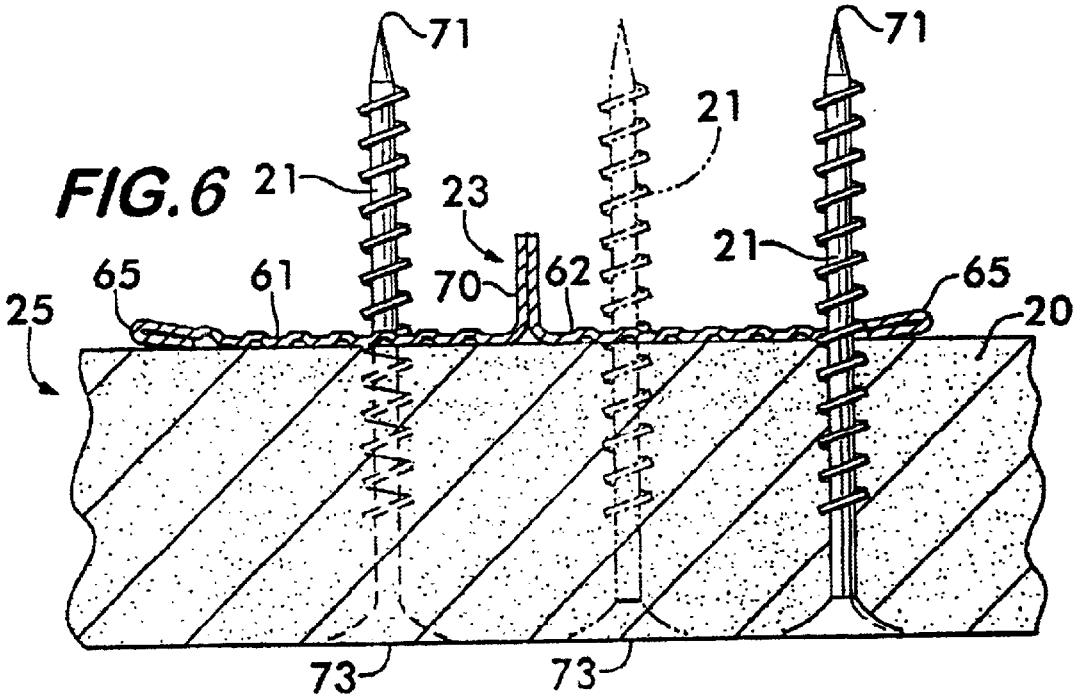
FIG. 6 is a cross sectional view taken in the direction of line 6—6 of FIG. 1 with drywall attached by a self-tapping screw at the edge of one flange, and with a screw in the drywall about to penetrate a flange to attach the drywall panel on another flange.
Figure 7:
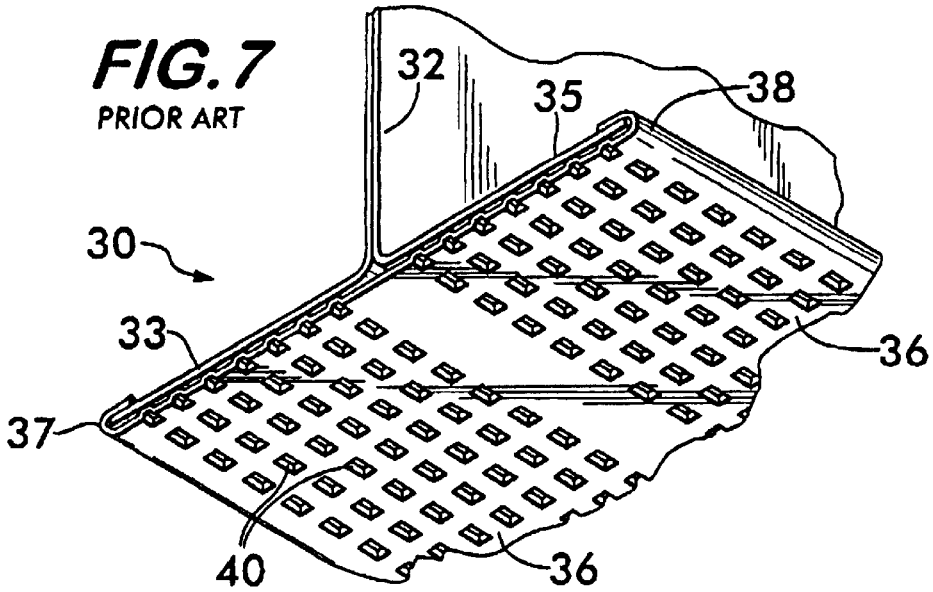
FIG. 7 PRIOR ART
FIGS. 7 through 10 show a prior art grid.

In FIGS. 5 and 6, there is also shown inserted screws 21 at 73, and a screw 21 about to penetrate the flange at 75, at positions between the web 70 and the hem 65.

What is claimed is:

1. In a suspended ceiling (25) having sheets of drywall (20) secured b self-tapping screws (21) to beams (23) that form a grid (22), each of the beams (23) having an inverted T cross-section with a bulb (59) at the top, a layered web (55, 56) extending downwardly from the bulb, and flanges (61, 62) extending oppositely from the web, the improvement comprising:

a. a portion extending continuously along the edge of each flange (61, 62) that is folded downwardly and inwardly on the bottom of each flange to form a hem (65) that reinforces the flanges and retains the screws (21) on the flanges, and b. upward indentations (60) on the bottom of each flange (61, 62) that seat the screws to permit the screws to engage and penetrate the flanges.

2. The beam of claim 1 having stitching means (67) in the web of the beam that fasten the layers of the web together.

* * * * *

UNITED STATES PATENT AND TRADEMARK OFFICE

CERTIFICATE OF CORRECTION

PATENT NO. : 6,722,098 B2
DATED : April 20, 2004
INVENTOR(S) : William J. Platt

It is certified that error appears in the above-identified patent and that said Letters Patent is hereby corrected as shown below:

Column 4,
Line 28, after "secured", delete "b" and insert -- by --.

Signed and Sealed this

Twenty-eighth Day of June, 2005

JON W. DUDAS
*Director of the United States Patent and Trademark Office*